US008082708B2

(12) United States Patent
Chen

(10) Patent No.: US 8,082,708 B2
(45) Date of Patent: Dec. 27, 2011

(54) WINDOW GLAZING CLEAT FOR SYNTHETIC DOORS WITH WINDOW LIGHTS

(76) Inventor: Kuei Yung Wang Chen, Taipei (TW)

( * ) Notice: Subject to any disclaimer, the term of this patent is extended or adjusted under 35 U.S.C. 154(b) by 0 days.

(21) Appl. No.: 12/500,003

(22) Filed: Jul. 9, 2009

(65) Prior Publication Data

US 2011/0005149 A1 Jan. 13, 2011

(51) Int. Cl.
*E06B 1/04* (2006.01)

(52) U.S. Cl. ..... 52/208; 52/204.64; 52/204.71; 52/204.62

(58) Field of Classification Search ..... 52/208, 52/204.62, 204.63, 204.64, 204.67, 204.7, 52/204.71, 656.3, 783.13, 784.11, 455, 784.1, 52/713

See application file for complete search history.

(56) References Cited

U.S. PATENT DOCUMENTS

| | | | | |
|---|---|---|---|---|
| 2,351,127 | A * | 6/1944 | Hodson | 52/656.9 |
| 3,081,849 | A * | 3/1963 | Eugene | 52/464 |
| 3,786,609 | A * | 1/1974 | Difazio | 52/784.13 |
| 3,950,894 | A * | 4/1976 | DiMaio | 49/501 |
| 4,327,535 | A * | 5/1982 | Governale | 52/309.11 |
| 4,930,276 | A * | 6/1990 | Bawa et al. | 52/211 |
| 5,768,837 | A * | 6/1998 | Sjoholm | 52/204.62 |
| 6,681,541 | B2 * | 1/2004 | Wang Chen | 52/455 |
| 6,832,457 | B2 * | 12/2004 | Geiger | 52/656.5 |
| 2006/0248833 | A1 * | 11/2006 | Autovino et al. | 52/455 |

FOREIGN PATENT DOCUMENTS

| | | | |
|---|---|---|---|
| EP | 473479 | A1 * | 3/1992 |
| EP | 2204526 | A * | 7/2010 |
| GB | 2323116 | A * | 9/1998 |
| GB | 2362676 | A * | 11/2001 |
| GB | 2451586 | A * | 2/2009 |

* cited by examiner

*Primary Examiner* — Robert Canfield
*Assistant Examiner* — Babajide Demuren
(74) *Attorney, Agent, or Firm* — Joseph L Strabala

(57) ABSTRACT

Synthetic doors composed a rectangular frame with of skins of compression molded sheets secured to opposite sides of the frame and a core of foamed plastics with a window light therein are improved with a novel glazing cleat for securing a window light in an aperture in such a door that includes plate that rests against edges the skins about the aperture, the plate having an upright rim engaging a face of a window light and downwardly directed flanges which, with tangs on a retainer member having a upright tab engaging the opposite face the window light when nesting with the plate sandwiches the skins between the flanges and tangs to take advantage of the mechanical strength of the skins. Further if a fire resistant plate is married to internal face of each skin, the cleat will take advantage of the mechanical strength of such plates in supporting the window light in the case of fires, even if the outer or exterior skin or skins are turned to ash by a fire. For increased fire resistance the core is formed of a fire resistant foam, such a phenolic foam.

8 Claims, 6 Drawing Sheets

WINDOW GLAZING CLEAT FOR SYNTHETIC DOORS WITH WINDOW LIGHTS

FIELD OF THE INVENTION

This invention relates to an improved two part, interlocking (nesting), glazing cleat designed to securely retain window lights in apertures in doors, and other structures, and particularly retain such widow lights in doors constructed of synthetic materials.

BACKGROUND OF THE INVENTION

Window lights are commonly placed in apertures in doors and secured by trim frames that overlap the periphery of the aperture on each side of the door. The trim frames are typically retained in the aperture by screws or other mechanical fasting mechanisms that connect the frames placed on opposite sides of the door. For example, see U.S. Pat. No. 5,941,032 issued to Lydon, Jr. and U.S. Pat. No. 7,086,206 issued to Wang, et al.

After such trim frames are secured in an aperture a glass pane (window light) is inserted in the opening in the frame and then secured in the frame with a glazing bead.

Such frames which abut on the exterior surfaces of the door in part, are exposed to external elements and, in the case of a fire door, to conflagration on one side or the other side of door. When made of plastic such frames fail when exposed to fire and the window light will be displaced enabling fire gases to pass through the aperture in the door when such lights are used in a fire door.

Further fire doors are rated according to standard test methods, such as ASTM E-152, UL 10(*b*) or NFPA 252. It measures the ability of a door to remain in an opening during a fire to retard the passage of the fire for determining the fire resistant properties of the door. In conducting such tests, doors are mounted in an opening of a fire proof wall after which one side of the door is exposed to a predetermined range of temperatures over a predetermined period of time, followed by the application of a high pressure hose stream that causes the door to erode and provides a thermal shock to the door.

Thus, unless the window light is properly secured in the aperture in such a door, which light is conventionally a glass pane with the imbedded wire mesh in fire doors, a stream of water will blow out the window light. Alternatively if the frame melts, the widow light may simply fall out of the aperture, if the frame is not made of metal. If the frame is made of metal it conducts heat to the window light causing it to crack and also can conduct heat to the components of the door leading to a premature failure of the door structure itself, particularly if it is a synthetic door.

From the foregoing it will be apparent that the glass pane must be properly secured in the aperture of a door to achieve fire retardation. When properly secure secured the aperture without depending on a typical trim frame, any thermal barrier provided by the frame and/or the trim around the window light is of secondary concern, allowing the frame/trim to be selected for aesthetic characteristics instead of its fire retention properties.

Metal frames have been used for fire door windows and have been painted to match or simulate wood but are not wholly satisfactory from an aesthetic standpoint. U.S. Pat. No. 4,637,182 issued to Ellsworth et al discloses a framing or trimming system wherein "bead strips" of an incombustible mineral material are provided with a wood veneer bonded thereto. The window pane is held in position by a plurality of small clips and associated nails which extend into an incombustible core of the fire door. See also U.S. Pat. No. 4,930,276 issued to Bawa, et al and U.S. Pat. No. 2,927,353 issued to Snikter, et al addressing the problems of retaining window lights in fire doors.

It is an object of this invention to provide an improved glazing cleat that will retain a window light in an aperture in a synthetic door, or other door like structures, when the door is subjected to fire (to a degree) and/or other similar physically challenging environment conditions.

Another object is the provision of novel glazing cleats with a low profile that can be easily hidden by an exterior frame around the periphery of an aperture in which the window light is installed and retained by the cleats.

A further object is the provision of a novel glazing cleat which can be used with conventional synthetic doors, such as those disclosed in U.S. Pat. No. 3,950,894 issued to DiMaio and in U.S. Pat. No. 4,550,540 issued to Thorn, which are widely used in the interior and exteriors of personal living spaces or workspaces because of their aesthetically pleasing surfaces. Reference is made to the construction of such synthetic doors disclosed in these patents as part of the disclosure herein.

It is also an object to provide a glazing cleat which allows the window light to be closely fitted in the aperture so that the light can be sealed in the aperture to prevent or limit hot gases from passing between the periphery of the light and the aperture.

A further object is the provision of a novel glazing cleat that cooperates with the skins used to form the door whereby a window light in an aperture in the door is mainly supported on such skins.

SUMMARY OF THE INVENTION

An improved glazing cleat for securing a window light in aperture includes a first part being a flat plate having a downwardly directed flanges at its opposite ends to form a U-shaped structure operable to engage the exterior surfaces of a door when installed in an aperture therein, an offset upwardly directed rim operable to engage one face of a window light, slots in the plate remote from the upwardly directed rim, and a second Z-shaped part having spaced tangs operable to fit into the slots in the flat plate and pierce the face of the aperture with an upwardly projecting tab operable to engage the other face of a window light when installed with a downwardly directed lip operable to engage an exterior surface of the door to stabilize the second part whereby a window light, secured by a plurality of such cleats, will be securely retained in an aperture through the cleats engagement with the exterior skins, even under very adverse conditions, such as high wind, pressurized water streams and/or fire.

The first part may also have downwardly directed tangs that pierce the face of the core, to increase the stability of the cleat in an aperture by sandwiching a skin of a door between its flange and these tangs, as shown in FIG. 4.

In addition the invention includes synthetic doors employing the glazing cleat to support a window light in apertures in such doors since the cleats allow the use of the strength of the skins and or fire resistant plates to support the window light in such doors.

DESCRIPTION OF AN EMBODIMENT

Figure 1:
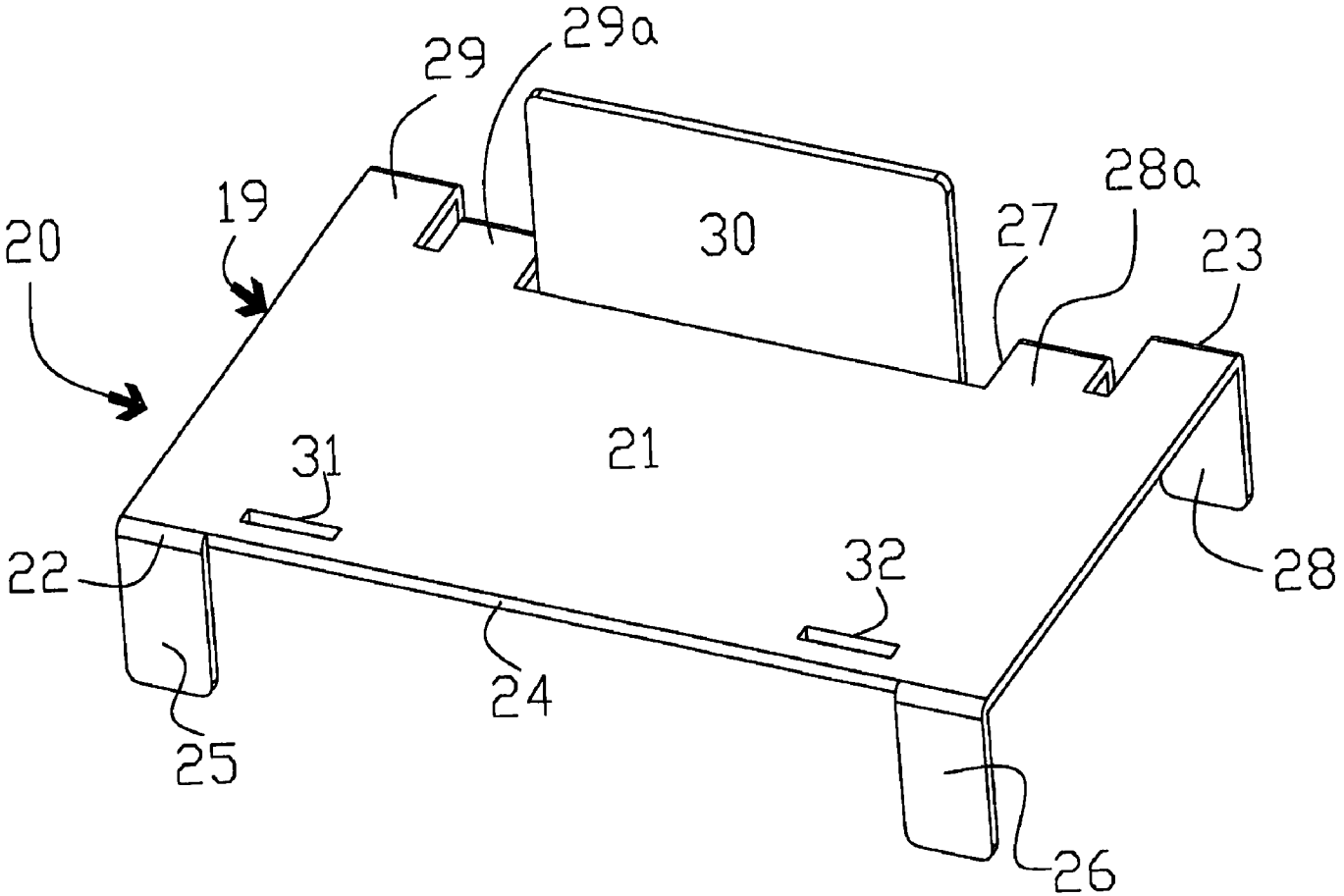
FIG. 1 is a perspective of one part (the larger part) of the novel cleat.

Referring to FIG. 1, which shows the larger flat plate part 19 of the novel two part cleat 20, it can be seen that this part consists of a flat rectangular plate 21 having a front end 22 and a back end 23. It is typically constructed of sheet metal having a gauge from 40 to 80 mm. The front end is notched with an opening 24 between two downwardly directed flanges 25 and 26, which flanges are perpendicular to the plane of the plate. These flanges are designed to engage the vertical surfaces of the door on one side of an aperture, when the flat plate is positioned in an aperture formed in a door and rests on these vertical surfaces. On the back end of the plate, adjacent to a large opening 27, there are two identical downwardly directed flanges 28 and 29 that are also perpendicular to the plate. As a result this part of the cleat has an inverted U-shape with flanges which will engage the exterior surfaces of a door on the opposite sides of an aperture. This engagement can be against the inside or outside vertical surfaces of a door. What is important, especially in a synthetic door of the type described, is that the novel cleats rests on the edges and supports the window light on the skins or plates forming the exterior components of the door instead of on the typical foam core employed in such doors.

An upwardly directed rim 30 is formed on the flat plate 21 adjacent to the back end 23 that is also perpendicular to the plane of the plate and parallel to the flanges 28 and 29. Typically it is formed from the opening between these flanges by bending a portion of the plate upward so it has a 90 degree angle with top face of the plate. This rim is designed to abut against one face of a window light placed in an aperture after this part of the cleat has been installed in the aperture.

As can be seen in FIG. 1 the flat plate 21 has two slots 31 and 32 remote from rim 30 having their longitudinal axis parallel with the surface of the rim. These slots, located adjacent to flanges 25 and 26, are adapted to receive the tangs of the smaller part 39 of the novel cleat 20 after the larger part 19 has been installed in an aperture.

Figure 2:
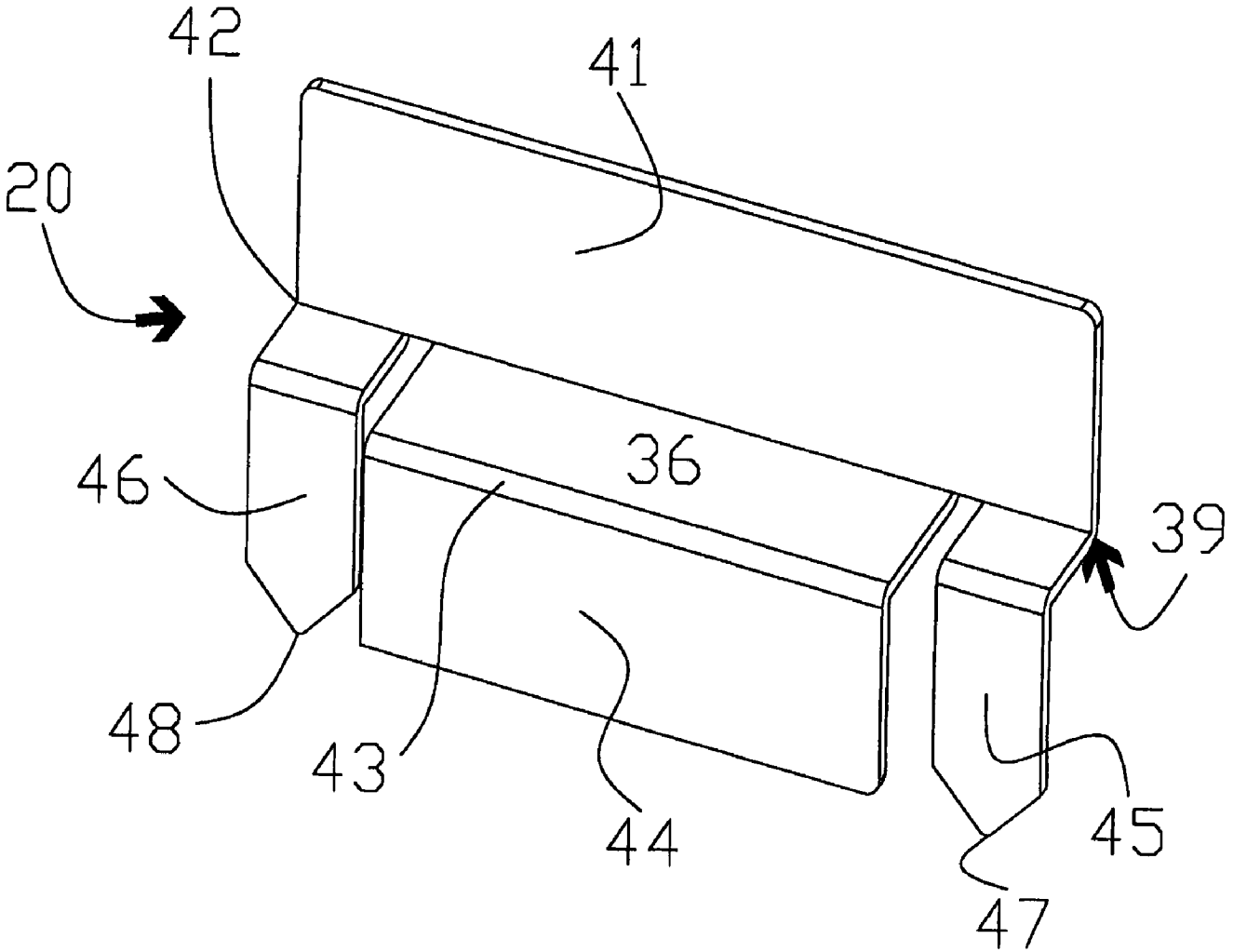
FIG. 2 is a perspective of the other part (the smaller part) of the novel cleat.
Figure 3:
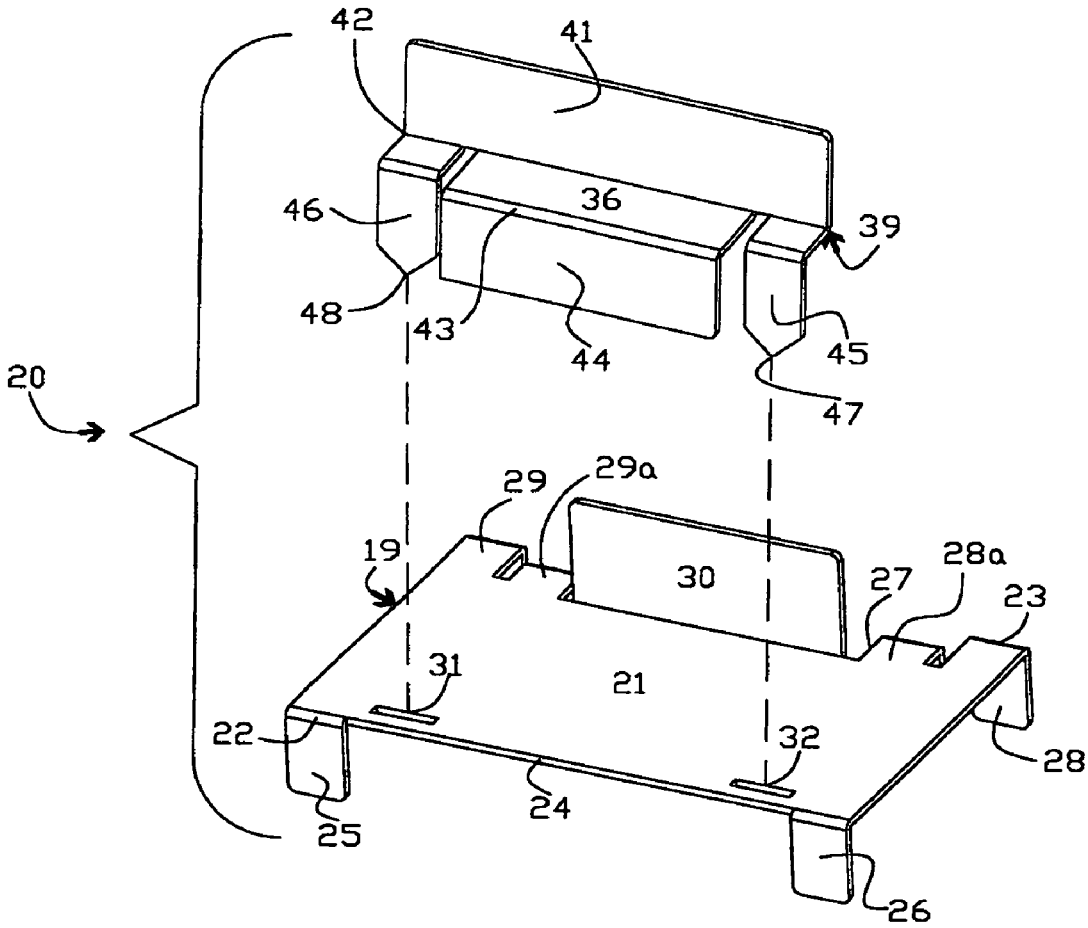
FIG. 3 is an exploded perspective of the two parts shown in FIGS. 1 and 2 illustrating the interlocking or nesting feature.

The smaller part 39 of the novel cleat 20 is illustrated in FIG. 2, where it can be seen that this part has a Z configuration when viewed from an edge. It includes a flat half plate 36 which has an upwardly disposed tab 41 at its back end 42 which, when it is nested with the larger part 19 of the cleat, abuts against a face of the window light inserted in an aperture so the light is retained between rim 30 and tab 41. On its front end 43 this part has a downwardly directed lip 44 which is perpendicular to the plane of this half plate. This lip is designed to engage the exterior vertical surface of a door about the aperture to stabilize the half plate in the aperture. Two spaced apart tangs 45 and 46 are formed at the edges of the half plate and oriented parallel to the lip, but inset from the front end of the half plate. These tangs, which usually include sharpened distal ends 47 and 48, are positioned on the half plate so that the tangs pass through (register with) the slots 31 and 32 respectively in the flat plate 21 when nested with it. When this occurs the lip is received in the notch 24 of flat plate allowing the tangs to be driven into the face of the core interlocking both parts of the novel cleat 20 in the aperture.

From the drawings and the forgoing description it can be appreciated that the low profile of the two part novel cleat allows the window light to be closely fitted to the perimeter of the aperture. As a result an intumescent caulking compound (not shown) is used to seal the window light in the aperture by placing a bead about the perimeter of the window light so it seal against the core. This bead will expand when subjected to heat providing an improved seal with a foam core of a synthetic door. To increase the fire resistance of such a door the foam core can be a phenolic foam.

Figure 4:
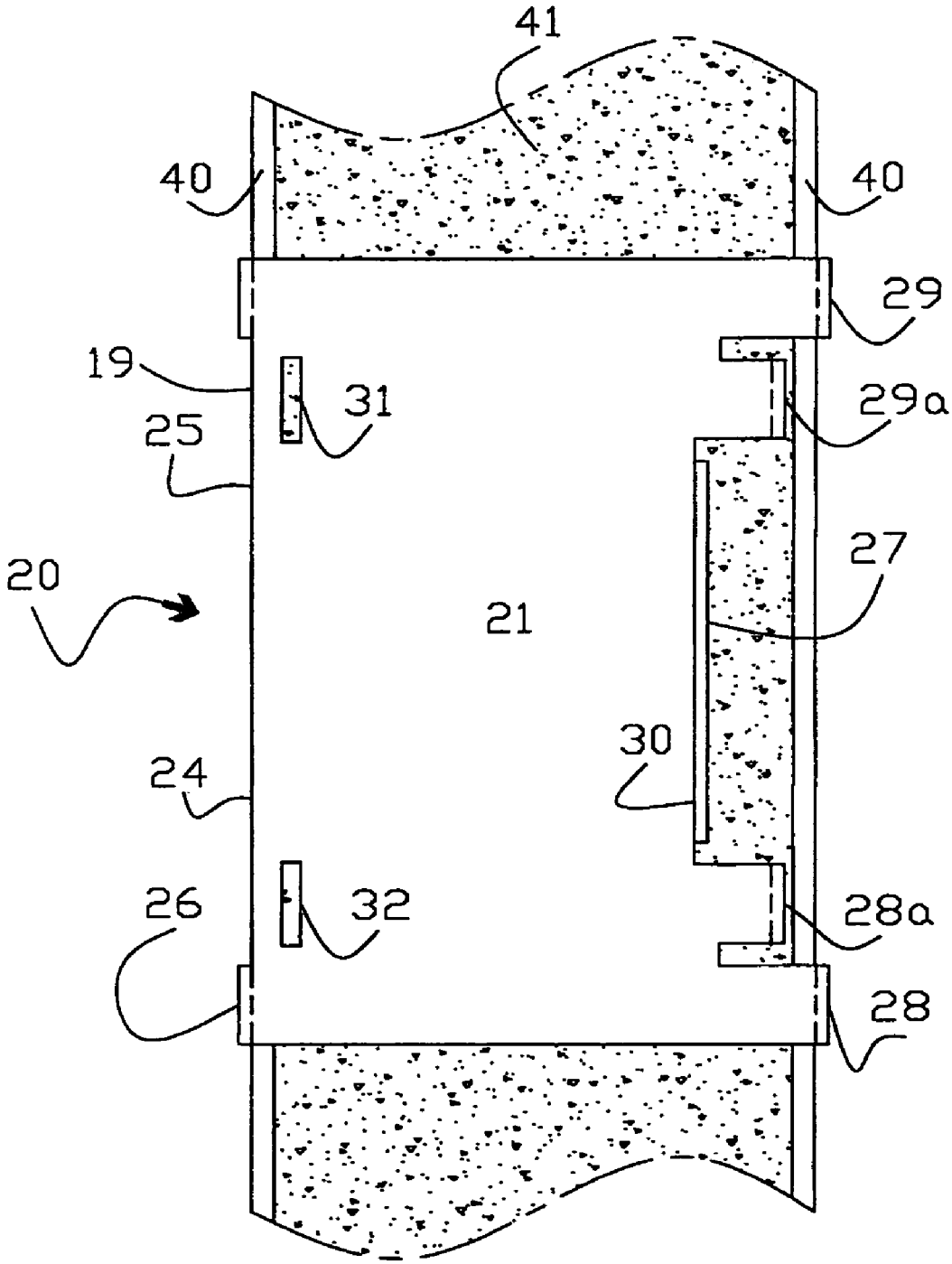
FIG. 4 is a broken away plan view of part of aperture in door illustrating the installation of the larger part of a modified cleat in a conventional synthetic door to retain a window light its aperture.

Referring to FIG. 4, the large part 19 of the cleat 20 is installed in a broken away portion of an aperture of a synthetic door, such as the door disclosed in U.S. Pat. No. 3,950,894 issued to DiMaio. Such a door is formed of two skins 40 of compression molded sheet material attach to the opposite sided a rectangular door frame formed with rails and styles, with the core filled with plastic foam 51. In this embodiment the flanges 28 and 29 are split and bent to form tangs **28*a* and 29*a* which are located inboard of these respective flanges. As can be seen from this drawing, skin 40 is secured between flanges 29 and tang 29*a* and between flanges 28 and tang 28*a*** taking advantage of the structural strength of the skin to secure a window light in an aperture formed in such a door. The cleat is especially useful in synthetic doors of the type described since the foam core of such doors provides a minimum of structural support.

One embodiment of the invention includes a synthetic door which has improved fire resistance and is referred to as a fire proof door, which is simply a door with better fire proof qualities than the typical synthetic door mentioned in the prior art.

Figure 5:
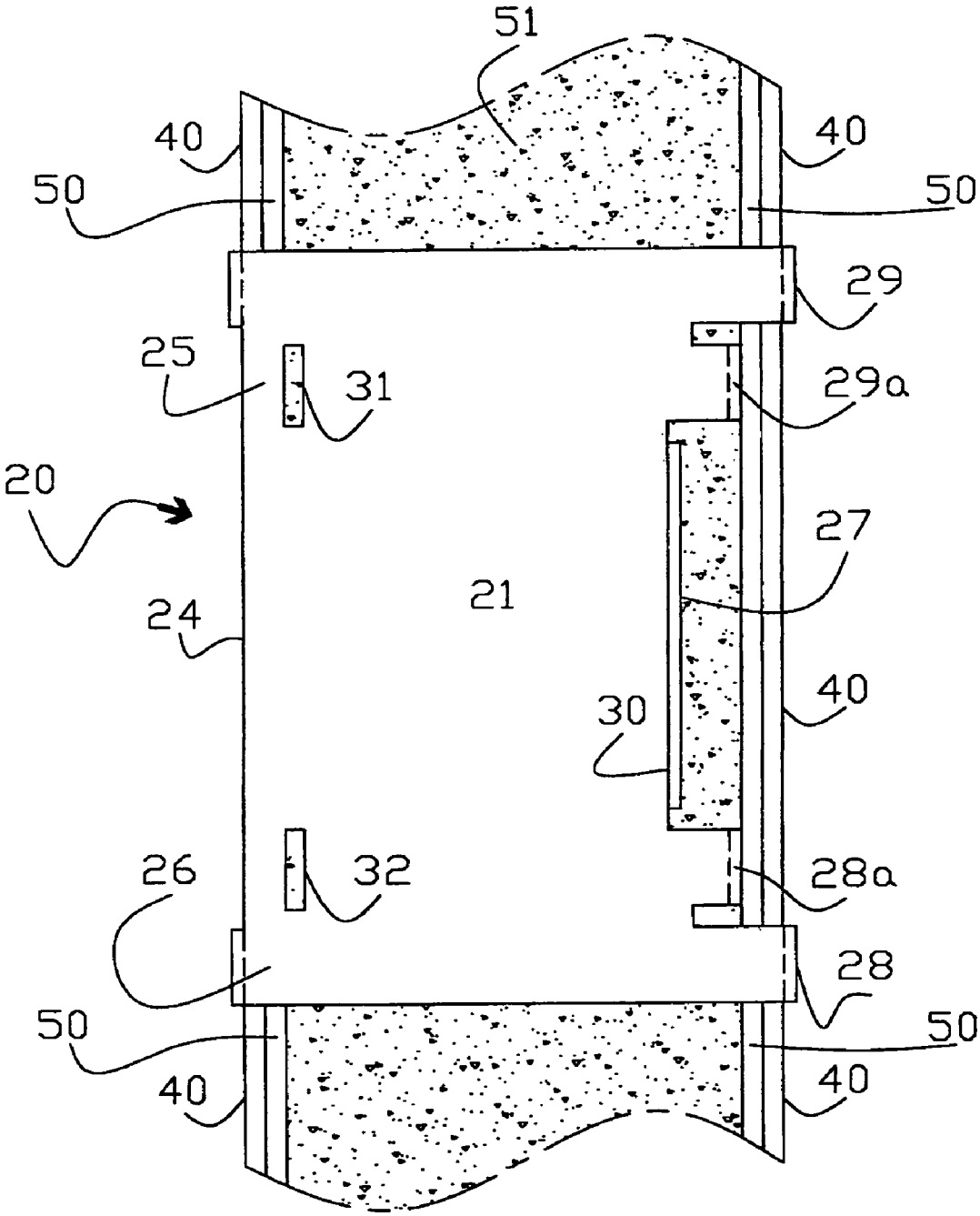
FIG. 5 is a broken away plan view of an aperture in a fire door having incombustible plates located contiguous to its outer skins which are applied to the exterior of the plates for aesthetic purposes.

The cleat 20, employed in such fire proof door, is shown in FIG. 5, which door has internal plates 50 of an incombustible material just beneath skins 40 and a center core 51 of incombustible materials, such a phenolic foam. In such a door the larger part 19 of the cleat 20 is sized so that it will have an incombustible plate disposed between its opposed flanges instead of the outer skins, so that a window light is held by the cleat secured to the incombustible plates 50. This is desirable because the external skin 40, when subjected to conflagration will be reduced to ash but the internal plates of incombustible material will continue to provide adequate support for the window light when this occurs. Such incombustible plates can be made of a "perlite plate" obtained from Nan Ya Plastics Company, as stock number FDCR0101, having a thickness of 30 to 60 mm. Also such "perlite plate" can be made from perlite and glue by compressing these ingredients to a thickness of between 30 to 60 mm and allowing the glue to cure. Other incombustible plates taught in the prior art can be used, see for example U.S. Pat. No. 6,886,306 issued to Churchill et al and U.S. Pat. No. 6,846,358 issued to Francis disclosing fire resistant boards (plates as described herein) for doors.

After a number of the larger parts 19 of the cleat 20 have been installed in an aperture, a window light is installed so that one face abuts against the rim 30. Thereafter the smaller part 39 of the cleat 20 is installed so that its tab 41 abuts on the opposite face of the window light as its tangs 45 and 46 are received in the slots 31 and 32 of the flat plate 21 and sunk into the core of the door. When so assembled the skin 40, shown in FIG. 4, will be secured on opposite sides by the cleat, that is between the tangs 45 and 46 and flanges 25 and 26 on the flat plate. By securing the skin between these members, the skin will not be displaced about the periphery of the aperture by adverse external conditions.

An important feature of the current invention is to secure either skin 40, or the plates of incombustible material in a fire door, between the mechanical fasteners created by the novel cleat 20 so a window light retained by the cleats will always be securely held in an aperture using the strength of the skin or in the fire proof door the plates, even under adverse conditions.

Figure 6:
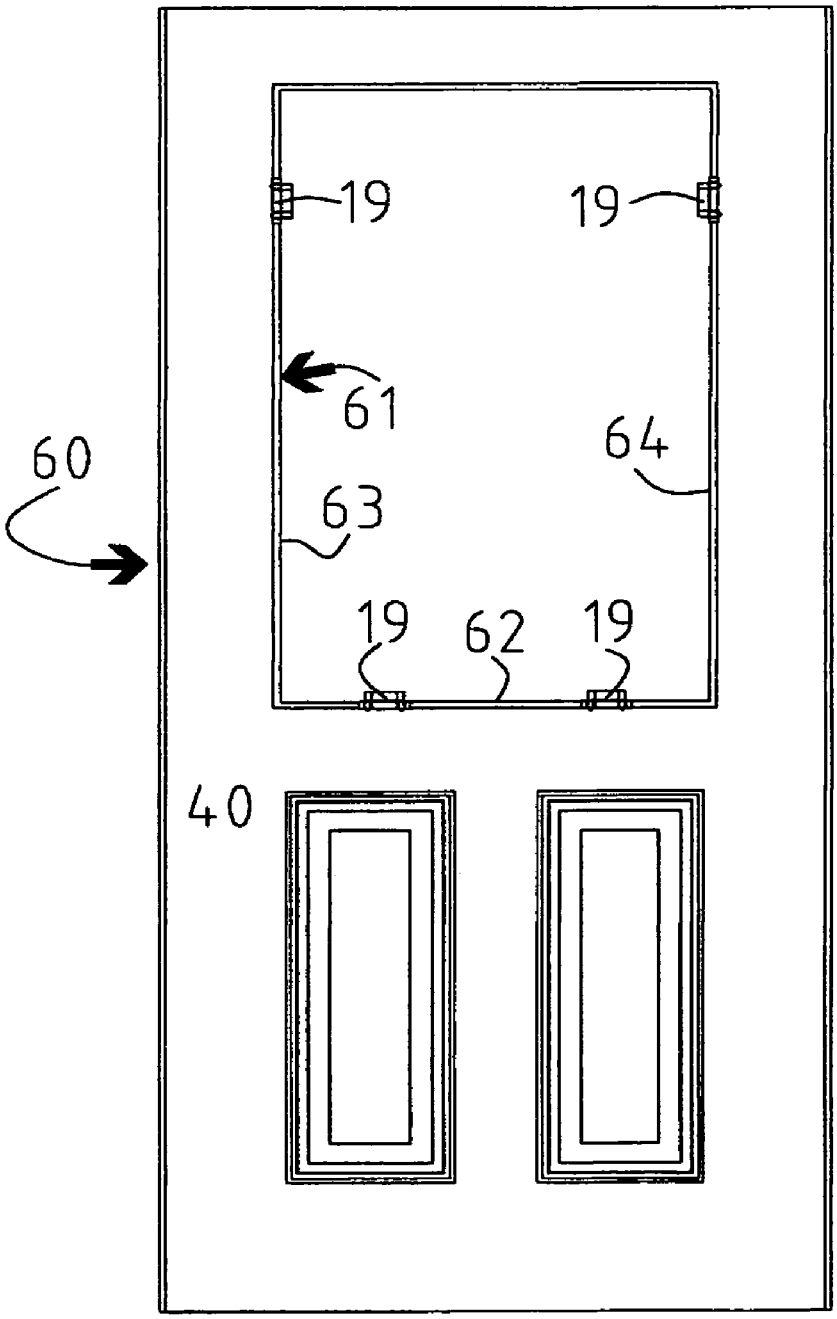
FIG. 6 is a plan view of a door having an aperture formed therein and showing the locations of the cleats in the aperture.

Referring to FIG. 6 a door 60 is illustrated with an aperture 61 formed in the door which can be a synthetic door or a fire door. After the aperture is formed the larger part 19 of the cleat 20 is placed at multiple locations about the periphery of the aperture, as shown. Because the cleat crates a very strong connection to the exterior skins 40, or alternatively the internal plates 50, only four cleats are necessary, but more can be employed if desired. Typically two cleats are installed at spaced intervals along the base 62 of the aperture and one on each vertical face 63 and 64 respectively of the aperture. After the larger parts have been installed a window light is inserted into the aperture which is sized to fit the aperture with a minimum space between these parts. With the window light abutting against rims 30, the smaller part 39 of the cleat is assembled, as previously described, so that its tab 41 abuts against the opposite face of the window light, securing the window light in the aperture. Moreover, the flat plates 21 of the cleats installed in the base of an aperture prevent the window light from sinking into the foam core of a synthetic door.

Because the components of the novel cleat 20 are composed of thin sheet metal, plastic or wooden frames can be assembled around the periphery of the aperture 61 as trim, after the window light (not shown) has been installed, by simply making small notches in the trim frames at places where the cleats are located in the aperture. Thereafter the trim frames can be glued in place since they are not structural. Moreover, better performance, in case of fire, is obtained by avoiding the use of screws.

Having described my invention I claim:

1. An improved two part glazing cleat for securing a window light in an aperture in a synthetic door constructed of a door frame, exterior skins and a foam core comprises:

a flat plate part having downwardly directed flanges at its opposite ends to form a U-shaped structure so its flanges are operable to engage the exterior faces of the skins of a door when installed in an aperture therein, said plate having an offset upwardly directed rim operable to engage one face of a window light and slots in the plate part remote from the upwardly directed rim, said plate part also having at least one downwardly extending tang adjacent to said rim operable to sandwich one of said skins between it and one of said flanges; and a second Z-shaped part having spaced apart tangs operable to fit into such slots in said flat plate and sandwich said other skin between said tangs and said other flange of said flat plate part, said Z-shaped part having an upwardly projecting tab operable to engage the other face of a window light when nested with said flat plate part, said Z-shaped part also having a downwardly directed lip operable to engage an exterior skin of said door to stabilize said second part whereby a window light secured by a plurality of such cleats in such aperture will be securely retained in such aperture.

2. A synthetic door having a window light with improved fire resistance comprising:

a rectangular door frame constructed of fire resistant rails and stiles;

a fire resistant plate secured to one face of said frame and a fire resistant plate secured to the other face of said frame creating a hollow core there between;

a fire resistant foam disposed in such hollow core forming a core;

a molded skin secured to and covering each fire resistant plate for aesthetic purposes;

an aperture formed in said skin covered plates and said core for a window light;

a flat metal plate having downwardly directed flanges at its opposite ends to form a U-shaped structure operable to engage the exterior faces of said skins and at least one secondary tab operable to engage an internal face of one of said fire resistant plates about such aperture to sandwich a one of said skins and an its plate there between, said flat metal plate having an offset upwardly directed rim operable to engage one face of a window light and slots in said plate remote from the upwardly directed rim; and a Z-shaped part having spaced tangs operable to fit into such slots in said flat metal plate and engage the internal surface of said other fire resistant plate so it and its contiguous skin are sandwiched between said tangs and the other of said flanges of said plate, said part having an upwardly projecting tab operable to engage the other face of a window light when nested with said plate in such aperture, said Z-shaped part also having a downwardly directed lip operable to engage an exterior face of one said skins to stabilize it, and a window light secured between said rim and said tab in such aperture whereby said window light will be retained in such aperture through the support of said fire resistant plates even under very adverse conditions, such as high winds, pressurized water streams and/or fire.

3. The fire resistant door defined in claim 2 wherein each fire resistant plate is a perlite plate having a thickness of 30 to 60 mm.

4. The fire resistant door defined in claim 2 wherein the core is a phenolic foam.

5. The fire resistant door defined in claim 2 wherein a plurality of flat metal plates parts and Z-shaped parts are used to secure the window light in the aperture.

6. A synthetic door with a window light comprising:

a rectangular door frame of rails and stiles;

an exterior skin secured to one face of said frame and an exterior skin secured to the other face of said frame creating a hollow core there between;

a foam disposed in such hollow core to form a core;

an aperture formed in said skins and said core for a window light;

a flat metal plate having downwardly directed flanges at its opposite ends to form a U-shaped structure operable to engage the faces of said skins around such aperture, said flat metal plate having an offset upwardly directed rim operable to engage one face of a window light and slots therein remote from the upwardly directed rim; and a Z-shaped part having spaced apart tangs operable to fit into such slots in said flat metal plate and sandwich said skin between it and a flange of said plate and having an upwardly projecting tab operable to engage the other face of a window light when nested with said flat plate in such aperture, said Z-shaped part having a downwardly directed lip operable to engage an exterior face of one said skins to stabilize it, and a window light secured between said rim and said tab in said aperture whereby said window light will be retained in such aperture.

7. A novel two part glazing cleat for a window light in a synthetic door constructed of a door frame and skins attached to opposite faces of the frame and a core of plastic foam comprising:

a u-shaped plate means operable to rest against the edges of the skins about an aperture in a synthetic door with a central upstanding rim operable to engage a face of a window light, said plate means having downwardly projecting elements at its opposite ends several of which are operable to sandwich one said skins between them; and retaining means operable to nest with said plate means and having an upright tab operable to engage the other face of a window light, said retaining means having downwardly projecting tang means cooperating with some of said elements of said plate means and operable to sandwich the other skin between said tangs and said elements whereby a window light will be retained between said rim and said tab by each cleat when a plurality of said cleats are assembled in such aperture in a synthetic door.

8. The novel two part cleat defined in claim 7 wherein the nesting is accomplished by passing the tangs through slots in the plate means.

* * * * *